United States Patent [19]

Price et al.

[11] 4,419,717

[45] Dec. 6, 1983

[54] CEILING SUPPORTED LIGHTING FIXTURES

[75] Inventors: Edison A. Price, New York; Fulgencio Bengochea, East Meadow, both of N.Y.

[73] Assignee: Edison Price, Incorporated, New York, N.Y.

[21] Appl. No.: 307,803

[22] Filed: Oct. 2, 1981

[51] Int. Cl.[3] ..... F21S 1/02

[52] U.S. Cl. ..... 362/148; 362/150; 362/217; 362/218; 362/364; 362/365; 362/368; 362/370; 362/371; 362/396; 362/404

[58] Field of Search ..... 362/148, 150, 364, 365, 362/396, 219, 218, 368, 370, 371, 404

[56] References Cited

U.S. PATENT DOCUMENTS

| | | | |
|---|---|---|---|
| 3,594,568 | 7/1971 | Guth | 362/221 |
| 3,816,880 | 6/1974 | Jacobs | 362/150 |
| 4,356,537 | 10/1982 | Stahlhut et al. | 362/148 |

*Primary Examiner*—Stephen J. Lechert, Jr.

*Attorney, Agent, or Firm*—McAulay, Fields, Fisher, Goldstein & Nissen

[57] ABSTRACT

In a ceiling supported lighting fixture, an improved mounting device is provided, having clamping plates with a notch for receiving a ceiling support member. The clamping plates are mounted to the end plates of the light fixture in two parallel pairs to effect alignment of the notch and plate, and the ceiling support member can be locked in the notch to prevent inadvertent relative movement. The locking is carried out by a latch member which is pivotally mounted on the clamping plate and moved between a locking and an unlocking position. The lighting fixture is also provided with an improved ballast holder including a ballast hole in a wall of the fixture and two identical ballast mounting clips, each formed from an integral blank of spring metal receiving an edge of the housing under tension and a spring clamp extending from the gap to hold a ballast in place upon insertion into the hole and between the two clips.

13 Claims, 16 Drawing Figures

CEILING SUPPORTED LIGHTING FIXTURES

BACKGROUND OF THE INVENTION

The present invention relates to improvements in lighting fixtures installed in and supported by suspended ceilings, and in particular to an improved clamping device for holding the lighting fixture in place on a ceiling support bar and an improved ballast holder for mounting the ballast in the lighting fixture housing.

While such devices are known in the art, there is a continual need for improved devices which are more versatile, simpler to use and simpler to manufacture.

SUMMARY OF THE INVENTION

The main object of the present invention is to provide improvements in ceiling supported, recessed lighting fixtures which are more versatile than the prior art while being easy to manufacture and easy to use.

Another object of the present invention is to provide an improved clamping device for holding a lighting fixture in place along a ceiling supporting bar.

This object is achieved in accordance with the invention by a clamping device comprising a mounting bracket having a notch therein for receiving a support, means attaching the mounting bracket to the end plate of the light fixture in parallel therewith to effect alignment of the notch with the ceiling supporting bar and means for locking the runner in the notch and for preventing inadvertent relative movement. This locking means comprises a latch member which is pivotally attached to the mounting bracket so that it can move from an unlocked position wherein the runner is free to be received in the notch to a locked position wherein a resilient end portion of the latch member clamps the received support into the notch under tension.

The clamping device also has the capability of being slidably mounted on the end plate to reduce the size of the fixture to facilitate packing, shipping and handling prior to the actual installation; and means for releasably retaining the bracket in the operating position.

Another object of the present invention is to provide an improved ballast holder for mounting a ballast in a lighting fixture housing which is capable of being originally assembled with the housing or of being retrofitted in existing housings which do not already contain a ballast.

This object is achieved in accordance with the present invention by a ballast holder which comprises two identical ballast mounting clips, each formed from an integral blank of spring metal and each comprising a first spring gap for receiving, under tension, an edge of a hole in the housing, a stop extends from the closed end of the gap substantially perpendicular thereto and a mounting spring clamp extends from the open end of the gap and substantially perpendicular thereto in the direction of the stop and is coactive with the stop to hold a ballast in place upon insertion between the two clips.

Each clip also has the feature of including a grounding finger extending from the closed end of the gap in a direction generally opposite to that of the stop and configured to contact the ballast under spring tension during insertion thereof, so as to scrape along the end of the ballast and make good grounding contact therewith even though the ballast may be coated with paint.

The ballast holder clips according to the present invention are particularly advantageous in view of the fact that they can be constructed from an integral blank of spring metal, preferably spring steel, and can be fitted or retrofitted into a housing without the need of tools or fasteners by merely providing an opening in the housing and pushing the clips onto the opposite ends of the opening, with the wall of the housing at those opposite ends being received in the spring gaps of the clips.

These and other objects and advantages of the present invention will be described in more detail in the following description in conjunction with the drawings wherein:

DETAILED DESCRIPTION OF THE INVENTION

Figure 1A:
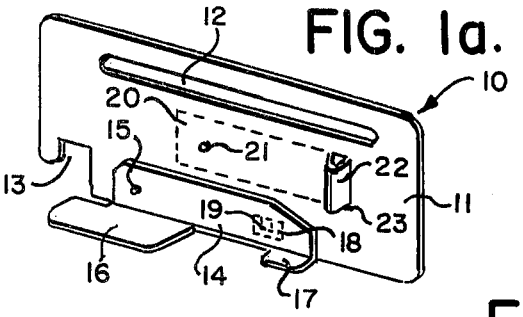
FIGS. 1*a* and 1*b* are perspective views of the left and right clamping devices according to the present invention.
Figure 1B:
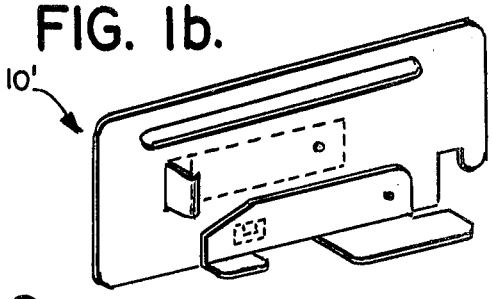
Figure 2:
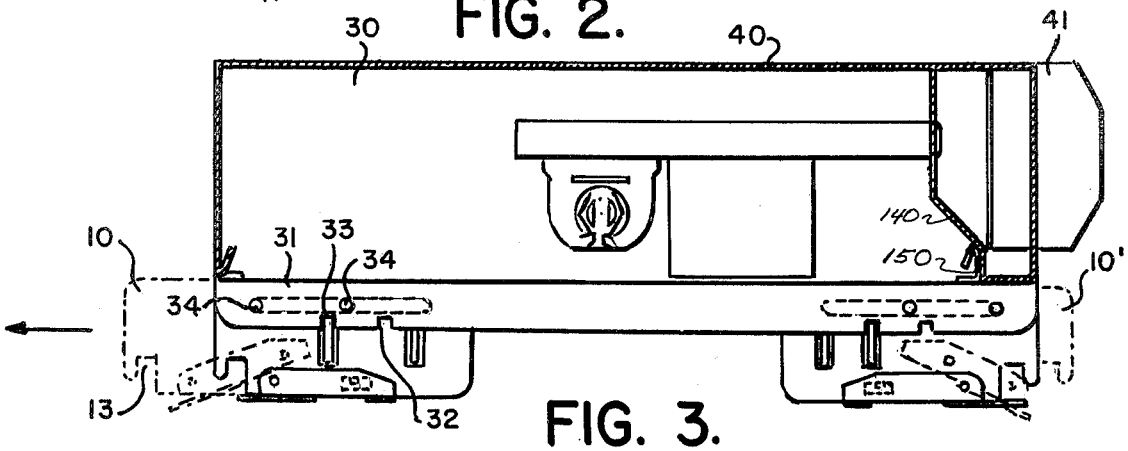
FIG. 2 is a view of the inside of the end of the lighting fixture with the clamping devices in place.
Figure 3:
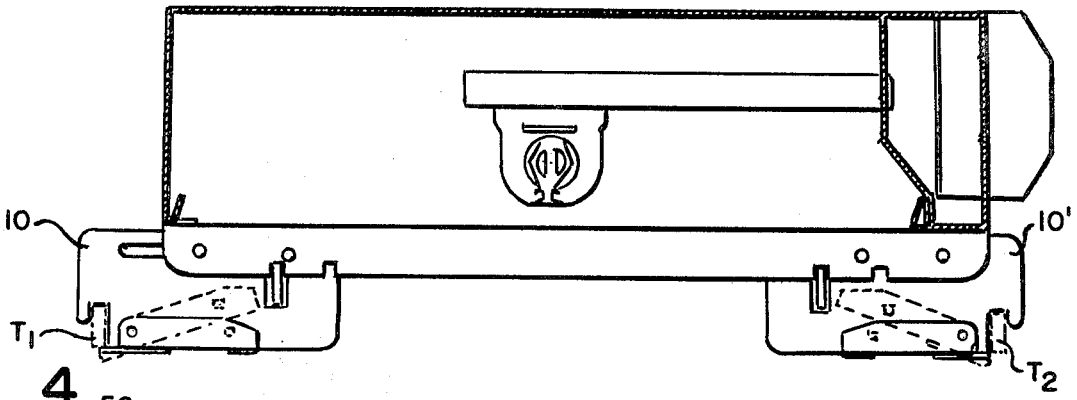
FIG. 3 is a view of the inside of the end of the lighting fixture with the clamping devices connected to supports.

Referring now to FIGS. 1–3, the clamping device 10 according to the present invention will be discussed in detail.

A lighting fixture housing 40 shown in FIG. 2, has end plates 30 at each end thereof to effect the mounting of the fixture housing on a support. In the preferred embodiment according to the present invention as portrayed, four clamping devices are utilized, one on each end of the two end plates 30. The clamping devices for each end plate are substantially identical except that the clamping devices are used on the lefthand sides and the righthand sides of the end plates and thus the clamping devices must be mirror images of each other. FIG. 1*a* shows a clamping device 10 used for the lefthand mount, and FIG. 1*b* shows a clamping device 10' used for the righthand mount. Aside from the fact that they are mirror images of each other, the two clamping devices 10 and 10' are identical, and thus for the sake of clarity only the lefthand clamping device 10 will be discussed in any further detail.

A clamping device 10 includes a mounting bracket or clamping plate 11 and an elongated slot 12 therein for attaching the mounting bracket to the lip 31 of the end plate 30, as will be explained hereinafter with respect to FIG. 2.

The mounting bracket 11 also includes a notch 13 which is configured as shown to receive a ceiling support bar T1, T2, as shown in FIG. 3.

The clamping device 10 also includes locking means comprising latch member 14 pivotally mounted on rivet 15 on clamping plate 11 and having locking member 16, preferably formed integrally therewith and ending perpendicularly with respect thereto and resiliently bendable so as to clamp the ceiling support bar T1, T2 in place under tension, as will be shown hereinafter with respect to FIG. 3. The latch member 14 also includes means for retaining same in the position shown in FIG. 1*a*, and this means includes a projection 18 which is configured to engage with aperture 19 in clamping plate 11 when in the position shown to releasably retain it in said position. The latching member 14 also includes a tab 17 for aiding in the pivotal movement thereof.

The mounting bracket 11 is attached to the lip 31 of end plate 30 by means of rivets 34 which are fixed in place on the lip 31 but permit the sliding movement of the clamping plate 11 to the extent of the slot 12.

The clamping device according to the present invention also comprises means for retaining the mounting bracket 11 in a number of positions along the path permitted by the aforesaid sliding movement. In the embodiment shown, this means enables the clamping plate or mounting bracket 11 to be releasably retained in a selected one of two positions defined by notches 32 and 33 along lip 31 of the end plate 30, and the resiliently releasable spring member, which is fixedly mounted at one end by rivet 21 to the side plate and has a protruding portion 22 extending through aperture 23 in the clamping plate 11 and which is positioned to overlie the notches 32 and 33 when the clamping plate is slid relative to the end plate.

When the protrusion 22 engages in one of the notches 32, 33, it fixes the mounting bracket in place and prevents it from any further sliding movement. To release the bracket for sliding movement, the spring member 20 is bent away from the sliding plate, thus removing the protrusion 22 from the notch 32, 33.

FIGS. 2 and 3 illustrate how the clamping device according to the present invention is utilized.

Prior to the installation of the fixture, the clamping plates 10, 10' are set in the position shown on the right-hand side of FIG. 2 in solid lines, that is, inwardly of the notch 32, thus enabling the fixture to take up the least amount of space for the most efficient packing, shipping and handling. The clamp 10 on the side with the ballast 41 is extended outwardly to the first notch to assume the position shown by the dotted lines on the right of FIG. 2. Preparatory to installation, the latching member 14 is moved to the open or unlocked position shown in dotted lines on the righthand side of FIG. 2.

On the other side of the end plate, the clamping device 10 is moved to the second notch 33, as shown in the dotted lines on the lefthand side of FIG. 2, and the latch member 14 is pivotally moved to the open position shown in dotted lines on the lefthand side of FIG. 2 from the locked position in which it is shipped. Thus, prior to installation, the clamping members are as shown in FIG. 2 in dotted lines.

FIG. 3 shows the mounting of the fixture on ceiling support bars T1 and T2. Since the ceiling support bars T1 and T2 are set apart by a standard distance desired from the width of the ceiling tiles, corresponding to the distance established by fixing the clamping plates 10 and 10' in the notches as shown in FIG. 3, the notches 13 on clamping plates 10 and 10' will be aligned with supports T1 and T2 and receive same without any further adjustment.

After the lighting fixture is placed in the position desired along the supports T1 and T2, it is time to clamp the lighting fixture in place. Thus, the latch members 14 are moved from the position shown in dotted lines in FIG. 3 corresponding to the unlocked position, to the position shown in solid lines in FIG. 3 corresponding to the locked position. In the locked position, the end portion 16 presses up against the underside of the top bulb of the ceiling support bars and resiliently biases same under spring tension to fix the fixture in place. In the locked position shown, the projection 18 engages with one edge of the aperture 19 to maintain the latch member 14 in the locked position.

The latch member 14 and the spring member 20 are preferably formed from spring steel, approximately 0.025 inches in thickness. The clamping plate is preferably formed from a rigid steel blank of approximately 0.06 inches in thickness.

Heretofore ballasts have been attached to light fixtures with the ballast entirely enclosed by the housing of the light fixtures, using threaded fasteners passing through holes in the mounting flanges at each end of the ballast, and through matching holes in the light fixture housing. Because ballasts have a limited lifetime and must be replaced when they fail, the usual practice to facilitate the replacement is to pre-attach threaded studs into the holes in the housing by welding or striking. The ballast is then placed so that the studs project through the ballast mounting flange holes at each end, and finally the ballast is retained in place by applying washers and nuts onto the threaded studs.

In the present invention only a minor part of the ballast is enclosed inside the housing. Most of the ballast protrudes through a hole cut in the housing. The arrangement reduces the size and bulk of the housing with a consequent saving in material, an increased ease of handling the fixture during installation and a reduced problem of interference with other ceiling components, such as hangers which may be adjacent to the fixture. Furthermore the heat generated by the ballast is less confined by the housing, as there is a free circulation of air past the portion of the ballast that extends beyond the housing, and the resulting reduction in ballast temperature increases the lifetime of the ballast.

Figure 4:
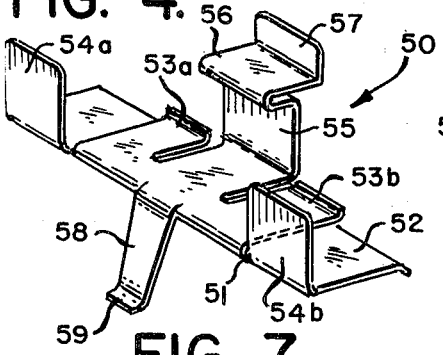
FIG. 4 is a perspective view of the ballast holder clip according to the present invention.
Figure 5:
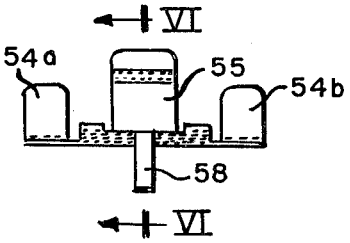
FIG. 5 is a front view of the clip according to FIG. 4.
Figure 6:
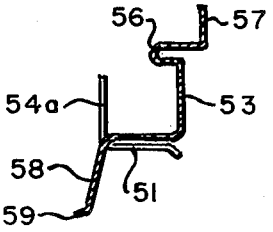
FIG. 6 is a sectional view of the clip along line VI—VI in FIG. 5.
Figure 7:
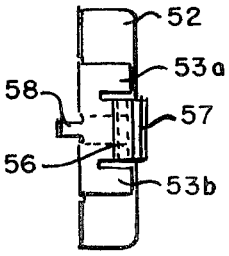
FIG. 7 is a top view of the clip according to FIG. 4.
Figure 8:
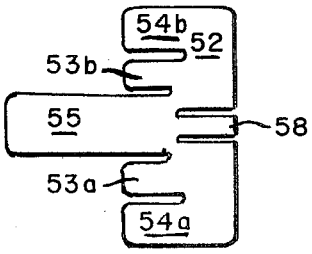
FIG. 8 is a top view of the blank used to form the clip shown in FIG. 4.
Figure 10:
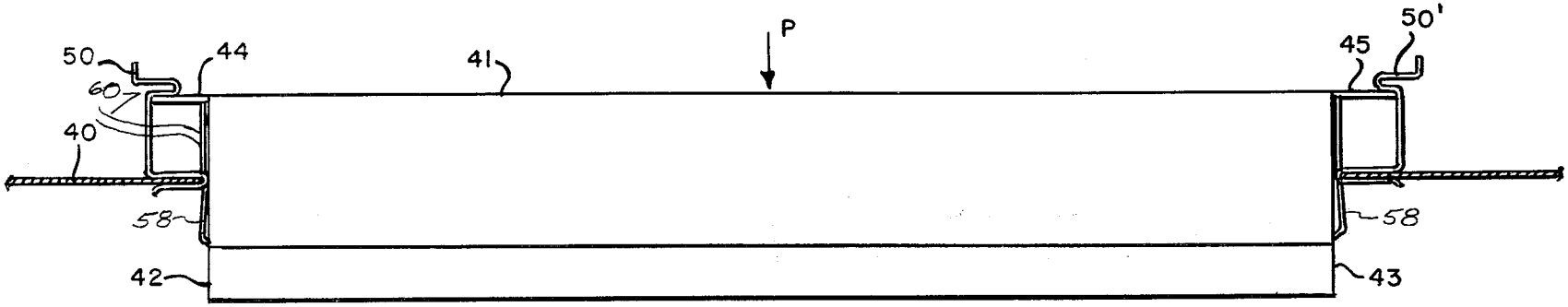
FIG. 10 is a side view showing the two clips mounted as in FIG. 9 and holding a ballast in place.

In the present invention, the ballast 41 in FIG. 10 is mounted to the fixture by causing it to pass part way through a hole cut in one wall of the fixture housing 40, and by retaining it in position by means of two identical mounting clips 50. The housing hole is just slightly larger than the outside dimensions of the ballast. A typical ballast measures 2.375 inches in width by 8.375 inches in length, and the hole to pass the ballast may be 2.400 inches in height by 8.400 in length. The clips 50 are formed from an integral blank, as shown in FIG. 8, of 0.025 inch thick spring steel bent to the shape shown in FIG. 4. The height of the blank of FIG. 8 is about equal to the height of the ballast and therefore just slightly less than the height of the opening so that the clip will be centered with the opening in order to hold the ballast reliably and to avoid interference with the ballast wires which might occur if the clip were not centered with the ballast.

Figure 9:
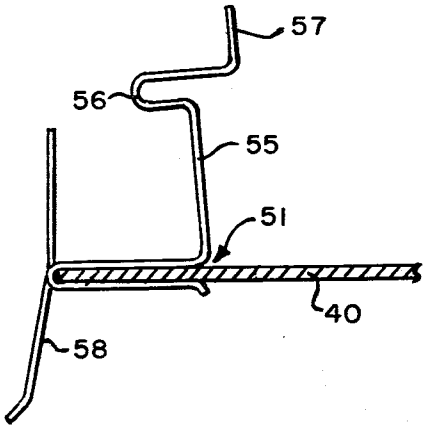
FIG. 9 is a side view of the clip mounted on the end of the ballast receiving hole in the fixture housing.

Each clip 50 includes means forming a spring gap 51 for receiving therein under tension as shown in detail in FIG. 9 an edge of housing 40 at one end of the ballast mounting hole. The gap 51 is formed between a base portion 52 having a flared free end and tabs 53*a* and 53*b* also having flared free ends. The gap 51 is formed such that it will receive the fixture wall under tension, so as to maintain the clip in place without any further connecting means.

As may be seen in FIG. 10, it is normal for the wire leads 60 of a ballast to exit through the ends of the ballast a short distance below mounting flanges 44, 45. If nothing prevented inserting the ballast into the hole all the way, so that the flanges 44, 45 contacted the housing 40, then the wire leads would be sheared-off by the edges of the housing at the ends of the hole. To prevent this stops 54*a* and 54*b* are provided, which limit the distance the ballast can be inserted into the hole to the degree necessary to safeguard the wire leads. Stops 54*a* and 54*b* act in conjunction with a mounting spring clamp 55, which extends from the open edge of the gap 51 upwardly substantially perpendicular thereto and has a projecting portion 56 followed by a tab 57 to aid in the opening and closing thereof. The portion 56 is disposed just above the top edges of stops 54*a* and 54*b*, which extends colinearly with each other to aid in the fixing of the ballast in place, as will be explained hereinafter.

Another feature of the clip 50 is the provision of a grounding finger 58, which extends from the closed end of the gap 51 and extends generally in the opposite direction from the stops 54*a* and 54*b* and extends approximately 75° with respect to the plain of the gap 51 and has a protruding burr portion 59 thereon, which operates to effect a grounding, as will be explained hereinafter.

The clips 50 and 50', as shown in FIG. 10, are usually mounted in place in the fixture during the manufacturing assembly procedure.

The ballast is then slid into the hole in the housing in the direction P, shown in FIG. 10, and during the sliding motion, the grounding fingers 58, and in particularly the burred end portions 59, scrape against the sides 42, 43 of the ballast, establishing a grounding contact therewith. Most ballasts have a light coating of enamel, and it has been found that the fingers 58 will scrape away this coating during the ballast insertion so that a reliable grounding contact is automatically established. The grounding fingers 58 are thereafter maintained in contact with the ballast sides 42, 43 as a result of their inherent spring tension.

The ballast is pushed in the direction P from the inside of the fixture toward the outside until the end flanges 44, 45 of the ballast reach the protruding portions 56 of the clip. Upon reaching that position, the clamp 55 is bent backwards by means of tab 57 so that the end flanges 44, 45 are received between the top edges of the stops 54*a*, 54*b*, and the lowermost portion of the protruding member 56, whereupon the tabs 57 are released and the clamp 55 holds the ballast firmly and securely in place as shown in FIG. 10.

Figure 11:
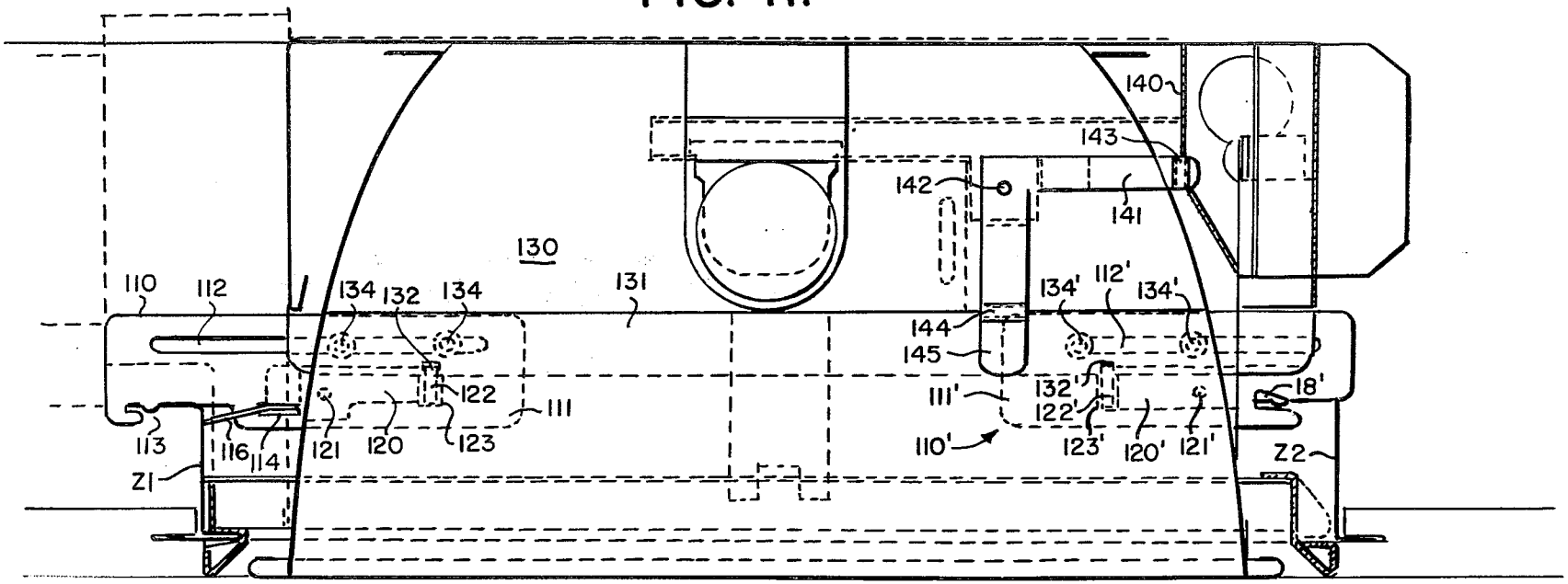
FIG. 11 is a side view of an alternative embodiment of a lighting fixture according to the invention.

Referring now to FIG. 11, the clamping device 110, 110', according to the present invention for use with a "Z" bar mounting will be discussed in detail.

The clamping devices 110, 110' for the left and rights plates are configured to attach to the top flanges of Z bars which face respectively away from and toward the lighting fixture.

The clamping devices 110, 110', are similar to device 10 of FIG. 1*a* and similarly include a clamping plate or mounting bracket 111, 111' and an elongated slot 112, 112' therein for mounting the clamping plate to the lip 131 of the end plate 130, as will be explained hereinafter.

The clamping plate 111 also includes a notch 113 which is configured as shown to receive one Z bar ceiling support Z1. Clamping device 110' includes plate 111' having notch 113' which is configured to receive one Z bar ceiling support Z2.

The clamping device 110 also includes locking means comprising locking member 116, formed integrally with and ending perpendicularly with respect to spring member 120 and which extends through plate 111 to aperture 119 and is resiliently bendable so as to attach to the Z bar member in place under tension.

The clamping plate 111, 111' is mounted to the lip 131 of end plate 130 by means of rivets 134, 134' which are fixed in place on the lip 131 to permit the sliding movement of the clamping plate 111, 111' to the extent of the slot 112, 112'.

The clamping device according to the present invention also comprises means for retaining the clamping plate 111, 111' in one or more positions along the path permitted by the aforesaid sliding movement. In the embodiment shown, this means enables the plates 111, 111' to be releasably retained in a locked position defined by notches 132, 132' along lip 131 of the end plate 130, and the resiliently releasable spring member 120, 120', which is fixedly mounted at one end by rivet 121, 121' to the end plate and has a protruding portion 122, 122' extending through aperture 123, 123', in the clamping plate 111, 111' and which is positioned to overlie the notch 132, 132' when the clamping plate is slid relative to the end plate.

When the protrusion 122, 122' engages in the notch 132, 132', it fixes the clamping plate in place and prevents it from any further sliding movement. To release the clamping plate for sliding movement, the spring member 120, 120', is bent away from the clamping plate, thus removing the protrusion 122, 122' from the notch 132, 132'.

In use, the clamping plate 110' is extended the proper distance until protrusion 122' engages in opening 123' in accordance with the spacing between the Z bars. The arm of the Z bar Z2 is engaged in opening 113'. The opening is angled upwardly and inwardly to permit the fixture to be held at a downward tilt when the arm of Z bar Z2 enters the opening 113'. The fixture is then pivoted upwardly into place about the Z bar arm. When plate 110 clears the corresponding arm of Z bar Z1, the plate 110 is pulled out to its extent. The fixture is then permitted to drop whereupon the bottom edge of plate 110 abuts the upper surface of the top flange of Z bar Z1. The plate 110 is thereupon pushed inwardly whereby the arm of Z bar Z1 enters slot 113. The inward movement of plate 110 continues until spring arm 116 clears the vertical web of the Z bar and falls behind the web, thereby locking plate 110 in position and simultaneously, protrusion 122 engages aperture 123 locking clamping plate 111 in place relative to the fixture. The plates may be released by reversing the above processes.

The ballast mounting means according to the present invention is shown in FIG. 11 with the additional feature of removable wireway cover means including the wireway cover 140 and a locking member 141 disposed on each end plate 130. The wireway cover 140 is preferably the length of the wireway and therefore also of the fixture and is held in place by the locking members 141. The locking members 141 are mounted on rivets 142 and have detents 143 for engaging with the side of the cover 140. The tabs 153 (FIG. 14) are engageable with member 150 (FIG. 2) to retain the cover in place.

The advantage of the wireway and wireway cover according to the invention permits all wiring to be received within and accessed from the interior of the fixture. That is, the wireway cover 140 and the facing wall of the fixture define therebetween a wireway that receives the fixture wiring as well as the ballast (which extends through the facing wall). Thus, the ballast as well as all wiring is now capable of being accessed from the inside of the fixture so that one does not have to remove the entire ceiling around the fixture for access to the ballast or the wiring. Moreover, the elimination of a continuous long protruding ballast enclosure eliminates interference with the ceiling supporting hangers preventing constraints on the positioning of the fixture.

Figure 12:
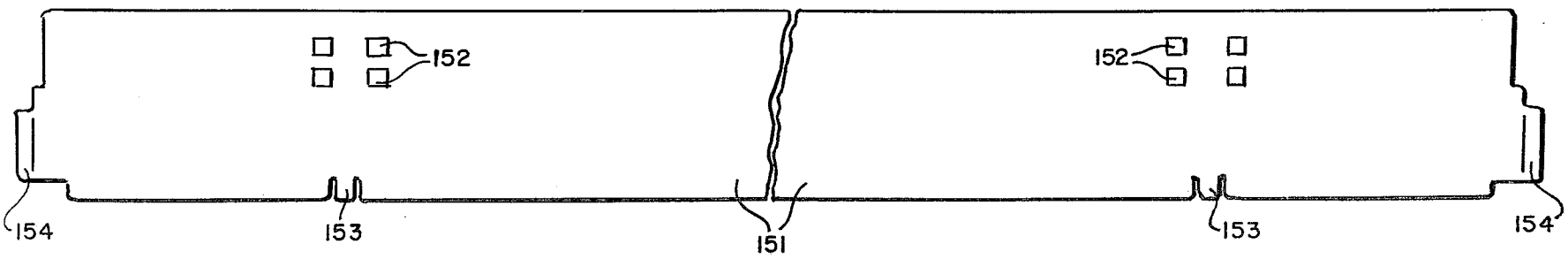
FIG. 12 is a top view of the wireway cover blanks according to the invention.
Figure 14:
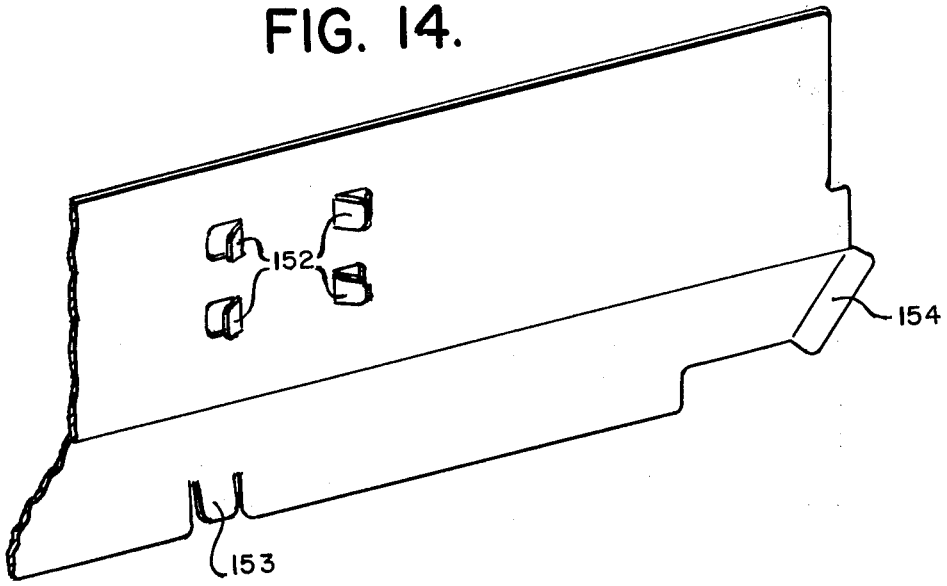
FIG. 14 is a detail of the cover of FIG. 13.
Figure 13:
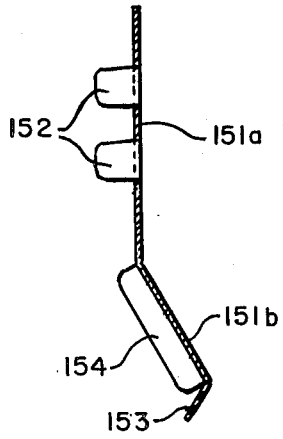
FIG. 13 is a side view of the cover of FIG. 12 when bent.
Figure 15:
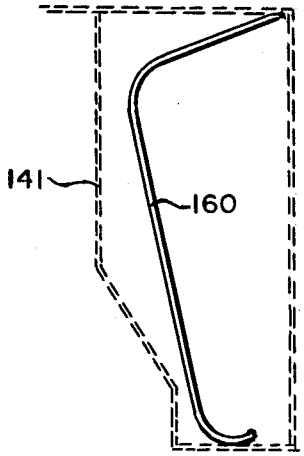
FIG. 15 is a side view of a further improvement according to the invention.

The wireway cover is shown in more detail in FIGS. 12–15 and includes a blank 151 shown in FIG. 12 which is bent to the configuration shown in FIGS. 13 and 14 to include three planar portions 151*a*, 151*b* and 151*c*. The blank 151 includes provisions for lancings 152 which provide a finger grip, mounting tabs 153 and end flaps 154 as shown.

The cover is mounted in place by engaging the tabs 153 on mounting member 150 and pivotting the cover upwardly and outwardly until the ends are engaged with detent 143 at each end plate whereby the cover will be held in the position shown in FIG. 11.

The assembly may also include a wire holder clip 160 which is placed along the length of the wireway formed by wireway cover 140 and which holds the wires in place during the removal and mounting of the cover. The wire clip is shown in place in FIG. 15.

It will be appreciated that the instant specification and examples are set forth by way of illustration and not limitation, and that various modifications and changes may be made without departing from the spirit and scope of the present invention.

What is claimed is:

1. In a ceiling supported lighting fixture having end plates and a device connected to the end plates for clamping the fixtures into a desired position on a ceiling support member, the improvement wherein the clamping device comprises two clamping plates on each end of the fixture, each having a notch therein for receiving a ceiling support member; and means for locking a track in the notches to prevent inadvertent relative movement, the locking means comprising mounting means for mounting the clamping plates to the side plate in parallel with respect thereto to effect alignment of the notch and a track, and a latch member on at least one clamping plate having an end portion disposed perpendicular to the clamping plate and wherein the locking means is movable between an unlocked position wherein the ceiling supports are free to be received in the notches and a locked position wherein the end portion biases the received support members into the notches under tension.

2. The clamping device according to claim 1, wherein the locking means comprises a latch member for each clamping plate and means pivotally mounting the latch member for movement of the end portion from an unlocked position wherein a ceiling support member is free to be received in the notch and the fixture can be moved along the ceiling support member to a locked position wherein the end portion biases the received ceiling support members into the notch under tension.

3. The clamping device according to claim 2, further comprising means for releasably retaining the latch member in the locked position.

4. The clamping device according to claim 3, wherein the releasable retaining means comprises an aperture in the clamping plate and a projection on the latch member configured to be received in the aperture when the latch member is in the locked position and to prevent pivotal movement into the unlocked position.

5. The clamping device according to claim 1, wherein the mounting means comprises means connecting the clamping plate to the end plate and comprises means for enabling sliding movement of the clamping plate relative to the end plate in the plane of the clamping plate and along a predetermined line perpendicular to the track to be received, and means coactive with the end plate for releasably indexing the clamping plate in at least one position along said predetermined line.

6. The clamping device according to claim 5, wherein the indexing means comprises at least one indexing notch in one side of the end plate parallel with said predetermined line; an indexing aperture in the clamping plate which is configured to encompass the indexing notch during sliding movement and a spring member mounted on the clamping plate and having an end portion protruding through the indexing aperture and towards the end plate and configured to be received in each indexing notch under spring tension to prevent sliding movement and wherein the spring member is resiliently bendable to remove the end portion from the notch to enable sliding movement.

7. In a ceiling supported lighting fixture having a housing means for mounting a ballast in the housing, the improvement wherein the ballast mounting means comprises two identical ballast mounting clips, each formed from an integral blank of spring metal and comprising means defining a first spring gap for receiving an edge of a ballast sized hole in the housing under tension, a stop extending at one end from the closed end of the gap substantially perpendicular thereto and of sufficient length to space wires from the ballast from the hole, and a mounting spring clamp extending at one end from the open end of the gap and substantially perpendicular thereto in the direction of the stop and coactive therewith to hold a ballast in place upon insertion into the ballast sized hole in the housing and between the two clips.

8. The ballast mounting means according to claim 7, wherein the stop comprises two planar spaced apart tabs having a colinear top edges at the ends thereof extending parallel to the gap and wherein the mounting spring clamp is disposed between the two tabs and the mounting spring clamp comprises a portion at the other end thereof extending towards the tabs and disposed above the height of the colinear tab edges.

9. The ballast mounting means according to claim 7, further comprising a grounding finger extending from the closed end of the gap in a direction generally opposite of the stop and configured to contact the ballast under spring tension during insertion thereof.

10. The ballast mounting means according to claim 7, wherein each clip comprises an integral blank of spring steel.

11. The ballast mounting means according to claim 7, wherein the housing further comprises a wiring and ballast enclosure with removable wireway cover over the enclosure facing the ballast and extending the length thereof and means for releasably holding the cover on the housing to effect removal thereof.

12. A fluorescent fixture having side and end walls forming an enclosure for at least one fluorescent lamp wherein said sidewalls are substantially parallel to the axis of the lamp, an opening in at least one of said side wall adapted to receive a ballast housing therethrough, a cover substantially equal in length to the length of said one side wall, mounting means in said enclosure for releasably mounting said cover therein in spaced and facing relationship to said one side wall to define therebetween an internal wireway for the fixture wires, whereby the fixture wiring and the ballast are accessible from the inside of said enclosure.

13. A fluorescent fixture as in claim 12, in which said mounting means comprises spring biased members at each end of said enclosure engagable with the respective ends of said cover to releasably retain said cover in place.

* * * * *